United States Patent [19]

Moldrup

[11] 4,207,716

[45] Jun. 17, 1980

[54] RECEPTACLE HAVING A CIRCUMFERENTIALLY PRE-STRESSED PERIPHERAL WALL COMPOSED OF CONCRETE SLABS

[75] Inventor: Soren J. Moldrup, Lyngby, Denmark

[73] Assignee: A/S Dansk Spaendbeton, Denmark

[21] Appl. No.: 939,696

[22] Filed: Sep. 5, 1978

[30] Foreign Application Priority Data

Sep. 14, 1977 [DK] Denmark ..... 4077/77

[51] Int. Cl.[2] ..... E04H 7/20; E04H 7/22

[52] U.S. Cl. ..... 52/224; 52/248

[58] Field of Search ..... 52/224, 248, 245, 271

[56] References Cited

U.S. PATENT DOCUMENTS

| | | | |
|---|---|---|---|
| 1,081,864 | 12/1913 | Perkins | 52/248 |
| 1,143,954 | 6/1915 | Hague | 52/248 |
| 1,320,989 | 11/1919 | Busch | 52/271 |
| 1,383,166 | 6/1921 | Steinkraus | 52/224 |
| 2,120,838 | 6/1938 | Lawrence | 52/271 |

*Primary Examiner*—James L. Ridgill, Jr.

*Attorney, Agent, or Firm*—Lane, Aitken & Ziems

[57] ABSTRACT

In a large size receptacle, e.g. for a mixture of liquid and solid manure, the peripheral wall comprises a circular series of reinforced concrete slabs having a plain external surface and presenting, at each vertical joint between successive slabs, groove shaped recesses or notches for receiving circumferentially extending prestressing wires.

6 Claims, 4 Drawing Figures

RECEPTACLE HAVING A CIRCUMFERENTIALLY PRE-STRESSED PERIPHERAL WALL COMPOSED OF CONCRETE SLABS

BACKGROUND OF THE INVENTION

The invention relates to a receptacle of the known type having a circumferentially pre-stressed peripheral wall composed of concrete slabs, the circumferential pre-stressing being established by means of wires extending around the external surface of the wall.

Within the farming industry such receptacles are used for storing a mixture of solid and liquid manure, but they may be used for many other purposes, e.g. as a flood protection around isolated oil tanks.

Normally, the receptacle is associated with a moulded foundation or bed on which the concrete slabs are vertically erected to form substantially a continuous circle, the diameter of which depends on the desired volume of the receptacle. Then the wires are extended horizontally around the wall of the receptacle and are tensioned sufficiently to stabilize the receptacle against the outwardly directed pressure from the contents of the receptacle. The vertical joints between the slab elements as well as the joints between these elements and the foundation may finally be made leakproof by applying a packing compound.

It is known to design the concrete slabs with horizontal strengthening ribs spaced over the height of the slabs and with similar ribs along the vertical edges of the slabs, and to place the circumferential pre-stressing wires along the upper surface of the horizontal ribs. In order that the wires may tightly embrace the external surface of the slabs, the vertical marginal ribs are formed with holes through which the wires may be pierced and which are substantially flush with said external surface. In this way the wires will be held safely in position and will also be well protected against mechanical damage but, on the other hand, the erection work becomes more difficult because the wires have to be passed through all of the holes which is both troublesome and time consuming.

SUMMARY OF THE INVENTION

From this prior art the receptacle according to the invention differs in that the concrete slabs have plain external surfaces and, adjacent their vertical joint edges, a groove shaped recess for each of the wires, the depth of said recesses increasing towards the edge faces.

By the elimination of the horizontal and vertical strengthening ribs, the strengthening duty of which may be undertaken by an ordinary reinforcement within the slabs, the production costs of these slabs may be reduced but, at the same time, provisions must be made to ensure that the circumferential pre-stressing wires are sufficiently localized during and after erection, and that no undue strain concentrations are created in the wires or between the wires and the concrete elements. For this purpose, groove shaped recesses are provided which, with a view to holding the wires during erection, may have a width such that the wires are held by friction against the side faces of the recesses and, with regard to the strain distribution, prevent the creation of more or less sharp bends in the wires over a joint between two adjacent slabs. A further effect is that at the joints the wires will be positioned close to the neutral plane of the slab elements which not only improves the distribution of the compressive strain in the concrete elements but also reduces the risk of a total or partial collapse of the wall of the receptacle in case of an external force, e.g. caused by a colliding vehicle.

In order that identical elements may be used for receptacles of varying diameters while maintaining the advantages referred to above, it is preferred, according to the invention, that the bottom of the recess merges tangentially into the external slab surface and that the depth increases progressively towards the edge face. In such case the wires will be more deeply positioned in the recesses, the more the angle between the elements, or the diameter of the receptacle, is reduced.

BRIEF DESCRIPTION OF THE DRAWINGS

The invention will now be more fully described with reference to the accompanying drawing illustrating a preferred embodiment of a receptacle according to the invention, and in which.

DETAILED DESCRIPTION OF THE PREFERRED EMBODIMENT

Figure 1:
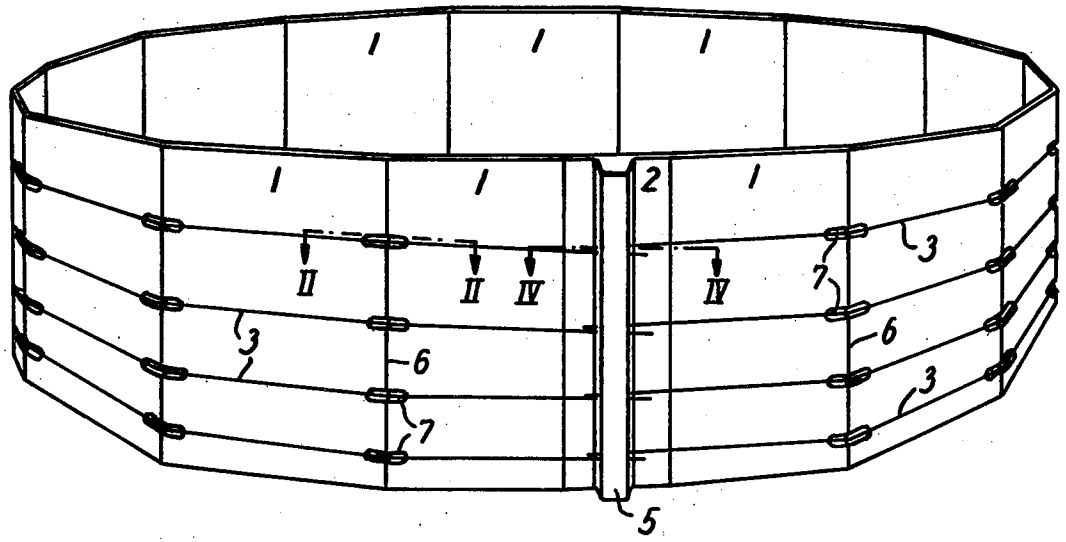
FIG. 1 shows a perspective view of the preferred embodiment, FIG. 2 a section along the line II—II in FIG. 1, FIG. 3 a similar section in a receptacle having a smaller diameter, and FIG. 4 a section along the line IV—IV in FIG. 1.

FIG. 1 shows a receptacle comprising a peripheral wall standing on a plane, support or bed, not shown, and built up by a plurality of identical concrete slabs 1 having a plain external surface, and a single anchoring concrete element 2. All of the elements may be provided with a reinforcement 8 of an ordinary type.

Figure 4:
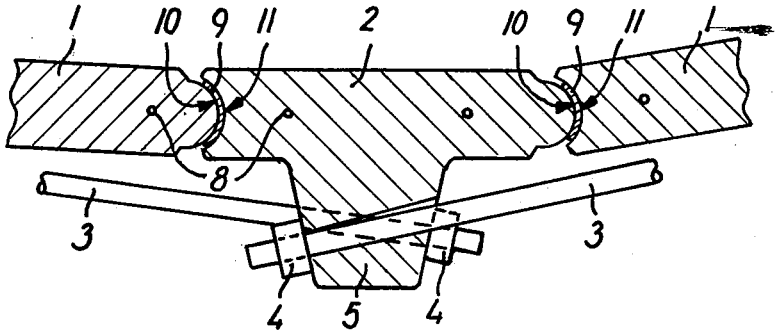

The slabs 1 are erected edge-to-edge along a substantially circular line. Wires 3 are extended around the receptacle and are tension ed and anchored, e.g. by means of nuts 4, in a rib 5 forming part of the anchoring element 2, as best illustrated in FIG. 4. The wires 3 tighten the elements 1 and 2 of the receptacle together against an internal pressure from the contents, not shown, of the receptacle.

The wires may suitably be of the known type comprising a protecting sheath in which the core of the wire may be displaced during the pre-stressing operation.

Adjacent the vertical joints 6 the concrete slabs 1 are provided with groove shaped recesses 7 to receive the wires 3. As shown in FIG. 1, the recesses 7 of each pair of recesses are in-line with each other such that the wires pass smoothly from one element to the adjacent one and are also held safely in position against vertical displacement.

Figure 2:
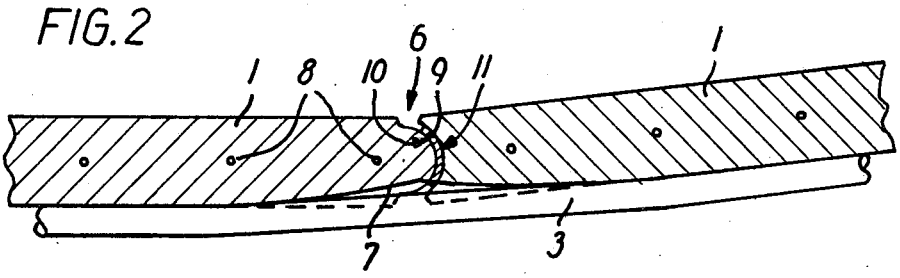
Figure 3:
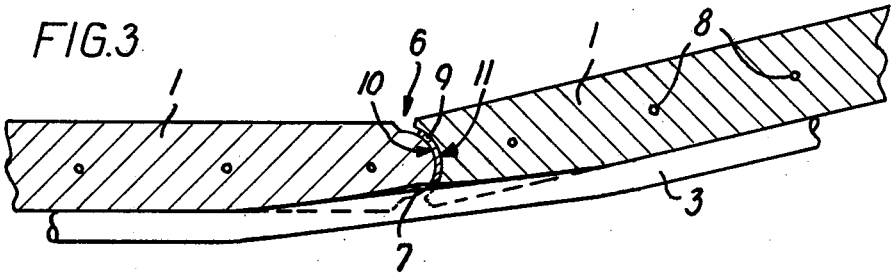

As most clearly illustrated in FIGS. 2 and 3, the bottom of the recesses merges tangentially into the external surface of the concrete slabs, and the depth increases progressively towards the marginal edge of the elements 1.

FIG. 2 shows parts of two adjacent slabs 1 of a receptacle having a rather great diameter while FIG. 3 shows parts of two identical slabs 1 of a receptacle having a rather small diameter, i.e. a receptacle comprising a smaller number of slabs 1. As shown, the recesses 7 should preferably be of such a shape that even in the last case, that is with the smallest angle between successive slabs, the wires 3 do not exert a concentrated pressure on the bottom of the recesses just at the joint 6.

The varying angular relationship of the slabs are allowed due to the fact that the marginal joint faces 10 and 11 of the slabs are shaped as complementary cylindrical surfaces with interposed pressure distributing and leak proofing packings 9 of a suitable material, e.g. plastic strips or a sealing compound.

What is claimed is:

1. A receptacle having a circumferentially pre-stressed peripheral wall composed of a plurality of concrete slabs, the circumferential pre-stressing being established by means of wires extending around the external surface of the wall, said concrete slabs each having a plain protuberance-free external surface and, adjacent their vertical joint edges, a groove-shaped recess for each of the wires, the depth of said recesses increasing towards the marginal edges of the slab.

2. A receptacle according to claim 1, wherein the bottom of the recess merges tangentially into the plain external surface of the slab, and wherein the depth increases progressively toward the marginal edge of the slab.

3. A receptacle of the type having a wall portion assembled from a plurality of substantially identical concrete slabs with circumferential pre-stressing wires extending around the external surface of the wall, each of said slabs having a planar, protuberance-free external surface portion, the opposite side edges of each slab having a joint face adopted to mate with the complementary joint face of an adjacent slab to define a joint, the planar marginal surface portions of each side edge having a recess formed therein for each pre-stressing wire, said recess extending from said planar marginal surface portion to said joint face and progressively increasing in depth toward said joint face, said recess on adjacent slabs substantially in-line with one another to define a recess-pair at each joint, each recess-pair adapted to accept a pre-stressing wire therein.

4. The receptacle claimed in claim 3 wherein the bottom surface of each recess tangentially merges with said planar marginal surface portion of said slab.

5. The receptacle claimed in claim 3, wherein the width of each recess is dimensioned to frictionally hold the pre-stressing wires against the side faces of the recess.

6. The receptacle claimed in claim 3, further comprising an anchoring slab adapted to anchor the ends of the pre-stressing wires, said anchoring slab having opposite side edges that include joint faces adapted to mate with the joint faces of adjacent slabs, and a vertically aligned, outwardly extending rib having a pair of holes formed therethrough for each pre-stressing wire, the opposite ends of each pre-stressing wire anchored in a respective one of said pair of holes.

* * * * *